US011242219B2

(12) United States Patent
Zhu et al.

(10) Patent No.: US 11,242,219 B2
(45) Date of Patent: Feb. 8, 2022

(54) STORY MONITORING METHOD WHEN ROBOT TAKES ELEVATOR, ELECTRONIC DEVICE, AND COMPUTER STORAGE MEDIUM

(71) Applicant: TENCENT TECHNOLOGY (SHENZHEN) COMPANY LIMITED, Guangdong (CN)

(72) Inventors: Xiaolong Zhu, Shenzhen (CN); Shanmin Tang, Shenzhen (CN); Yongsheng Liu, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 884 days.

(21) Appl. No.: 16/068,750

(22) PCT Filed: May 4, 2017

(86) PCT No.: PCT/CN2017/082970

§ 371 (c)(1),
(2) Date: Jul. 9, 2018

(87) PCT Pub. No.: WO2017/190666

PCT Pub. Date: Nov. 9, 2017

(65) Prior Publication Data

US 2019/0031469 A1 Jan. 31, 2019

(30) Foreign Application Priority Data

May 5, 2016 (CN) ..... 201610296629.4

(51) Int. Cl.

| | |
|---|---|
| ***B66B 5/00*** | (2006.01) |
| ***B66B 1/06*** | (2006.01) |
| ***B66B 1/34*** | (2006.01) |

(52) U.S. Cl.
CPC ..... *B66B 5/0012* (2013.01); *B66B 1/06* (2013.01); *B66B 1/3438* (2013.01); *B66B 1/3492* (2013.01)

(58) Field of Classification Search
CPC ..... B66B 5/0012; B66B 1/06; B66B 1/3438; B66B 1/3492

(Continued)

(56) References Cited

U.S. PATENT DOCUMENTS

| | | | | |
|---|---|---|---|---|
| 9,980,246 | B2 * | 5/2018 | Pattabiraman ..... | H04W 16/22 |
| 2012/0041593 | A1 * | 2/2012 | Ichinose ..... | B66B 1/2458 700/258 |

(Continued)

FOREIGN PATENT DOCUMENTS

| | | | |
|---|---|---|---|
| CN | 203133585 | U | 8/2013 |
| CN | 104145172 | A | 11/2014 |

(Continued)

OTHER PUBLICATIONS

Communication dated May 7, 2019, from the Japanese Patent Office in counterpart Application No. 2018-523802.

(Continued)

*Primary Examiner* — Jeffrey Donels
(74) *Attorney, Agent, or Firm* — Sughrue Mion, PLLC

(57) ABSTRACT

A story monitoring method when a robot takes an elevator is provided. The method including: obtaining gravity acceleration of the robot in a static state in an elevator and transient acceleration of the robot in a moving state in the elevator, a starting story number, and a story height of each story; obtaining an acceleration change waveform of the robot; comparing the acceleration change waveform by using an acceleration waveform classifier of the elevator, to obtain a movement status of the elevator at each moment; obtaining actual displacement of the elevator in a complete (Continued)

movement status of the elevator; and obtaining a story that the elevator is on after a complete movement status according to the actual displacement of the elevator, the starting story number, and the story height of each story.

18 Claims, 10 Drawing Sheets

(58) Field of Classification Search
USPC ..... 187/391
See application file for complete search history.

(56) References Cited

U.S. PATENT DOCUMENTS

| | | | | |
|---|---|---|---|---|
| 2014/0312884 | A1 | 10/2014 | Reilio et al. | |
| 2018/0073951 | A1* | 3/2018 | Venkatraman | H04W 4/025 |
| 2019/0345000 | A1* | 11/2019 | Park | B66B 1/461 |
| 2019/0352125 | A1* | 11/2019 | Wooten | B66B 5/0025 |

FOREIGN PATENT DOCUMENTS

| | | | |
|---|---|---|---|
| CN | 105540356 | A | 5/2016 |
| ER | 2 748 093 | A2 | 7/2014 |
| FI | 20116342 | A | 7/2013 |
| JP | 59-17614 | A | 1/1984 |
| JP | 5210414 | A | 8/1993 |
| JP | 2003-095545 | A | 4/2003 |
| JP | 2009258821 | A | 11/2009 |
| JP | 2010-287016 | A | 12/2010 |
| JP | 2011-068453 | A | 4/2011 |
| JP | 5003573 | B2 | 8/2012 |
| JP | 2012-196731 | A | 10/2012 |
| JP | 5449873 | B2 | 3/2014 |
| JP | 2014115823 | A | 6/2014 |
| WO | 2013/084154 | A2 | 6/2013 |
| WO | 2013098486 | A1 | 7/2013 |

OTHER PUBLICATIONS

Communication dated Mar. 17, 2021 from the European Patent Office in EP Application No. 17 792 492.5.
International Search Report and Written Opinion in corresponding International Application No. PCT/CN2017/082970, dated Aug. 7, 2017.
Communication dated Oct. 31, 2018, from the State Intellectual Property Office of People's Republic of China in counterpart Application No. 201610296629.4.
International Search Report for PCT/CN2017/082970, dated Aug. 7, 2017.
English Abstract of JP 05-210414.
Communication dated Jun. 14, 2019 from Korean Intellectual Property Office in counterpart KR Application No. 10-2018-7014862.

* cited by examiner

STORY MONITORING METHOD WHEN ROBOT TAKES ELEVATOR, ELECTRONIC DEVICE, AND COMPUTER STORAGE MEDIUM

RELATED APPLICATION

This application is a National Stage of International Application No. PCT/CN2017/082970, filed on May 4, 2017, which claims priority to Chinese Patent Application No. 201610296629.4, entitled "STORY MONITORING METHOD AND APPARATUS WHEN ROBOT TAKES ELEVATOR", filed on May 5, 2016 in the State Intellectual Property Office, which is incorporated herein by reference in its entirety.

FIELD

Apparatuses, methods, and devices consistent with the present disclosure relate to the field of robots, and in particular, to a story monitoring method when a robot takes an elevator, an electronic device, and a computer storage medium.

DESCRIPTION OF RELATED ART

With the development of intelligent navigation, more robots are developed. When performing indoor autonomous navigation, a robot usually needs to take an elevator to go to another story. After entering the elevator, the robot needs to record a story that the elevator is on, so as to prepare for an operation of exiting the elevator subsequently. In conventional art, the robot communicates with the elevator by using Bluetooth or another communications module, and invokes a current location interface of the elevator, to obtain current location information of the elevator. However, to implement this manner, a communications device or the like needs to be installed in the elevator. For an elevator in which a communications device is not installed, communication cannot be performed. Consequently, information of a story that the elevator is on cannot be obtained.

SUMMARY

According to one or more exemplary embodiments of this application, a story monitoring method when a robot takes an elevator and an electronic device are provided.

According to one or more exemplary embodiments, a story monitoring method when a robot takes an elevator, including:

obtaining gravity acceleration of a robot in a static state in an elevator and transient acceleration of the robot in a moving state in the elevator, a starting story number, and a story height of each story;

subtracting the gravity acceleration of the robot in the static state from the transient acceleration of the robot in the moving state to obtain an acceleration change waveform of the robot;

comparing the acceleration change waveform by using an acceleration waveform classifier of the elevator, to obtain an acceleration waveform classifier to which the acceleration change waveform belongs, obtaining a configured state machine and a conversion relationship between different movement statuses in the state machine, determining a moving direction of the elevator according to the conversion relationship and a next acceleration waveform classifier adjacent to an acceleration static waveform classifier, and obtaining a movement status of the elevator at each moment according to a correspondence between the acceleration waveform classifier and a movement status of the elevator and the moving direction of the elevator;

obtaining transient acceleration and a total time of the elevator in a complete movement status, obtaining an instantaneous speed of the elevator according to the transient acceleration, and then obtaining actual displacement of the elevator according to the instantaneous speed and the total time of the elevator, the complete movement status including a process of a static state, to an accelerating state, to a uniform speed state, to a decelerating state, and to a static state; and obtaining a story that the elevator is on after a complete movement status according to the actual displacement of the elevator, the starting story number, and the story height of each story.

According to one or more exemplary embodiments, a story monitoring apparatus when a robot takes an elevator, including:

a data obtaining module configured to obtain gravity acceleration of a robot in a static state in an elevator and transient acceleration of the robot in a moving state in the elevator, a starting story number, and a story height of each story;

an estimation module configured to subtract the gravity acceleration of the robot in the static state from the transient acceleration of the robot in the moving state to obtain an acceleration change waveform of the robot;

a status detection module configured to: compare the acceleration change waveform by using an acceleration waveform classifier of the elevator, to obtain an acceleration waveform classifier to which the acceleration change waveform belongs, obtain a configured state machine and a conversion relationship between different movement statuses in the state machine, determine a moving direction of the elevator according to the conversion relationship and a next acceleration waveform classifier adjacent to an acceleration static waveform classifier, and obtain a movement status of the elevator at each moment according to a correspondence between the acceleration waveform classifier and a movement status of the elevator and the moving direction of the elevator;

a displacement calculation module configured to: obtain transient acceleration and a total time of the elevator in a complete movement status, obtain an instantaneous speed of the elevator according to the transient acceleration, and then obtain actual displacement of the elevator according to the instantaneous speed and the total time of the elevator, the complete movement status including a process from a static state, to an accelerating state, to a uniform speed state, to a decelerating state, and to a static state; and a story monitoring module configured to obtain a story that the elevator is on after a complete movement status according to the actual displacement of the elevator, the starting story number, and the story height of each story.

Details of one or more embodiments of the present disclosure are provided in the following accompanying drawings and descriptions. Other features, objectives, and advantages of the present disclosure become clear in the specification, the accompanying drawings, and the claims.

BRIEF DESCRIPTION OF THE DRAWINGS

To describe the technical solutions in the embodiments of the present disclosure or in the existing technology more clearly, the following briefly describes the accompanying drawings required for describing the embodiments or the existing technology. Apparently, the accompanying drawings in the following description show merely some embodiments of the present disclosure, and a person of ordinary skill in the art may still derive other drawings from these accompanying drawings without creative efforts.

DESCRIPTION OF EXEMPLARY EMBODIMENTS

To make the objectives, technical solutions, and advantages of the present disclosure clearer and more comprehensible, the following further describes the present disclosure in detail with reference to the accompanying drawings and exemplary embodiments. It should be understood that the specific embodiments described herein are merely used to explain the present disclosure but are not intended to limit the present disclosure.

It can be understood that, terms such as "a first" and "a second" used in the present disclosure may be used to describe various components, but the components are not limited by the terms. The terms are merely intended for distinguishing the first component from another component. For example, without departing from the scope of the present disclosure, a first client may be referred to as a second client, and similarly, a second client may be referred to as a first client. The first client and the second client are both clients, but are not a same client.

Figure 1:
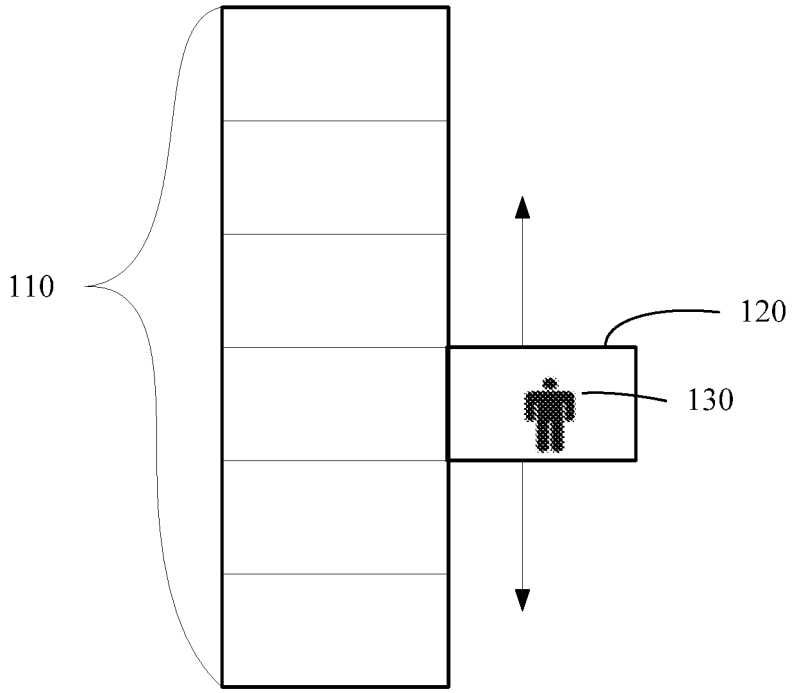
FIG. 1 is a schematic diagram of an application environment of a story monitoring method and apparatus when a robot takes an elevator according to an exemplary embodiment.

FIG. 1 is a schematic diagram of an application environment of a story monitoring method and apparatus when a robot takes an elevator according to an exemplary embodiment. As shown in FIG. 1, the application environment includes a story 110, an elevator 120, and a robot 130. The elevator 120 is installed in an elevator operation channel on the story 110. The robot 130 is placed in the elevator 120. An acceleration sensor is installed on the robot 130. By means of the acceleration sensor, acceleration of the robot 130 in a process of ascending and descending with the elevator 120 can be detected.

Figure 2:
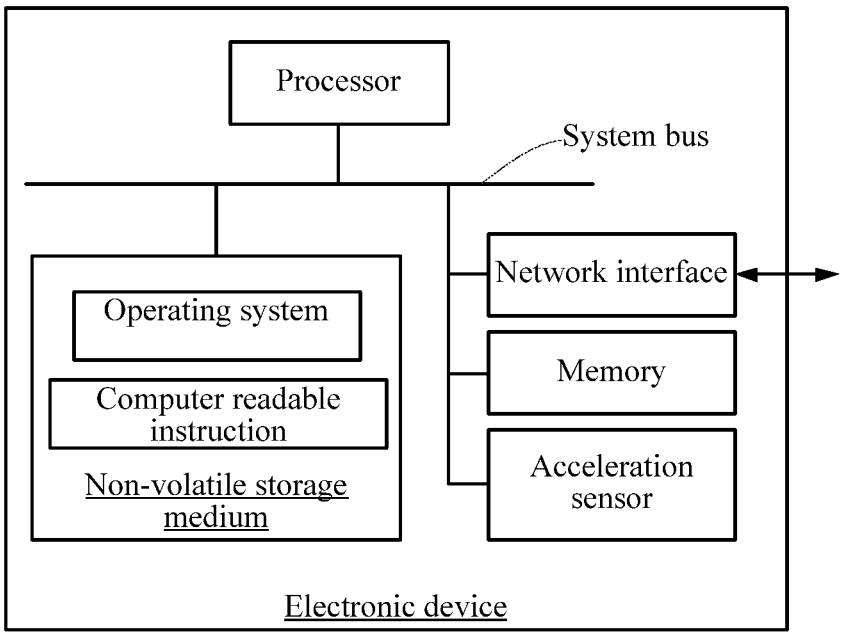
FIG. 2 is a schematic diagram of an internal structure of an electronic device according to an exemplary embodiment.

FIG. 2 is a schematic diagram of an internal structure of an electronic device according to an exemplary embodiment. As shown in FIG. 2, the electronic device includes a processor, a non-volatile storage medium, a memory, and an acceleration sensor that are connected by using a system bus. The storage medium of the device stores an operating system and a computer readable instruction. When the computer readable instruction is executed by the processor, a story monitoring method when a robot takes an elevator can be implemented. The processor is configured to provide computing and control capabilities to support running of the entire terminal. The processor is configured to perform the story monitoring method when a robot takes an elevator. The method includes: obtaining gravity acceleration of a robot in a static state in an elevator and transient acceleration of the robot in a moving state in the elevator, a starting story number, and a story height of each story; subtracting the gravity acceleration of the robot in the static state from the transient acceleration of the robot in the moving state to obtain an acceleration change waveform of the robot; comparing the acceleration change waveform by using an acceleration waveform classifier of the elevator, to obtain an acceleration waveform classifier to which the acceleration change waveform belongs, and obtaining a movement status of the elevator at each moment according to a correspondence between the acceleration waveform classifier and a movement status of the elevator; obtaining transient acceleration and a total time of the elevator in a complete movement status, obtaining an instantaneous speed of the elevator according to the transient acceleration, and then obtaining actual displacement of the elevator according to the instantaneous speed and the total time of the elevator, the complete movement status including a process from a static state, to an accelerating state, to a uniform speed state, to a decelerating state, and to a static state; and obtaining a story that the elevator is on after a complete movement status according to the actual displacement of the elevator, the starting story number, and the story height of each story. The electronic device may be a device installed on the robot and having capabilities of processing and monitoring acceleration, and the like, or may be a smartphone, a device having a gyroscope and a processor, or the like. A person skilled in the art should understand that the structure shown in FIG. 2 is merely a block diagram of some exemplary structures related to solutions of this application, and does not constitute a limitation to the terminal to which the solutions of this application is applied. A specific terminal may include more or less components than what is shown in the drawing, or combine some components, or have different component layouts.

Figure 3:
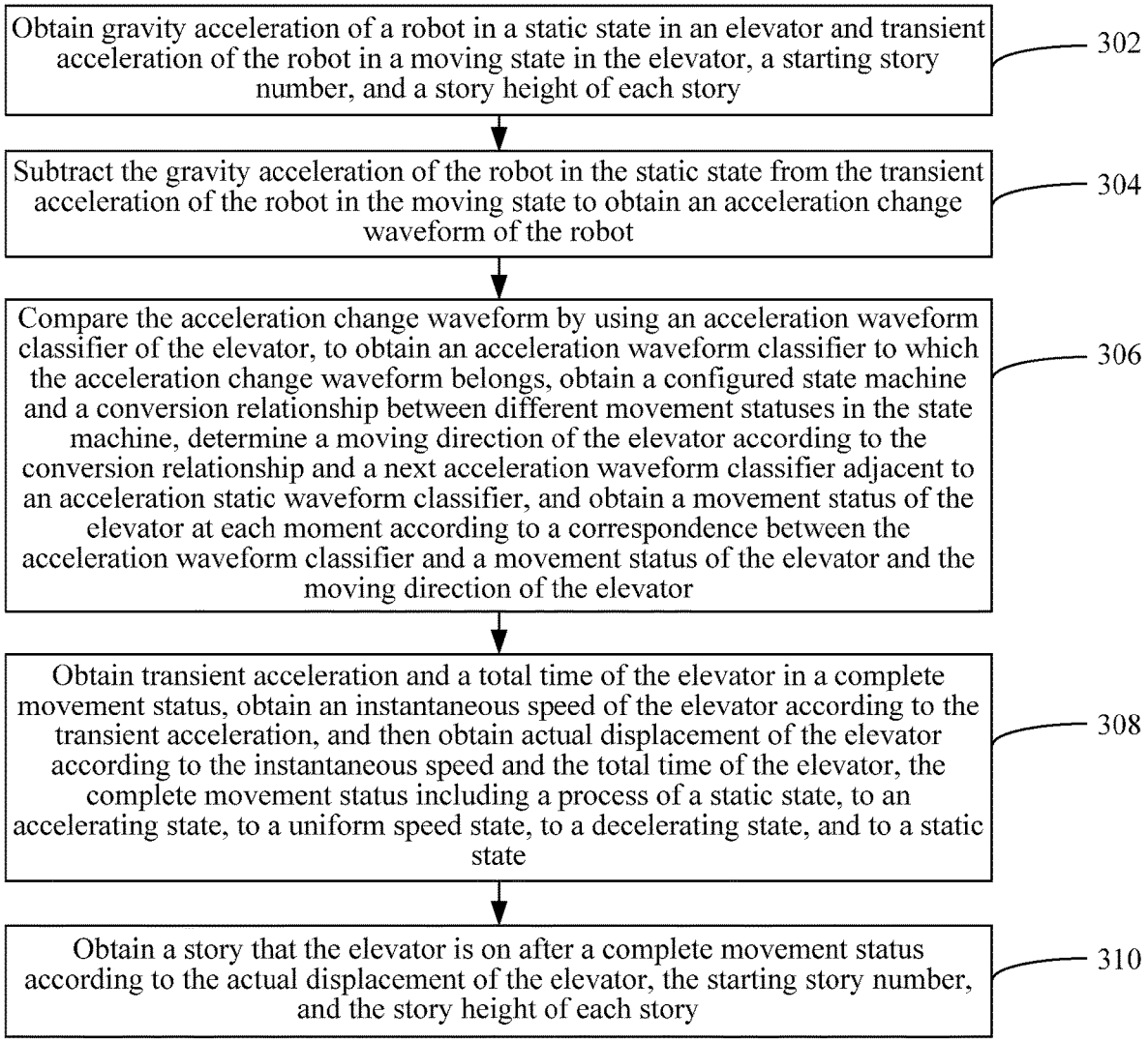
FIG. 3 is a flowchart of a story monitoring method when a robot takes an elevator according to an exemplary embodiment.

FIG. 3 is a flowchart of a story monitoring method when a robot takes an elevator according to an exemplary embodiment. As shown in FIG. 3, in an exemplary embodiment, the story monitoring method when a robot takes an elevator is applied to the electronic device shown in FIG. 2, including:

Step 302: Obtain gravity acceleration of a robot in a static state in an elevator and transient acceleration of the robot in a moving state in the elevator, a starting story number, and a story height of each story.

In this exemplary embodiment, the acceleration sensor in the robot can detect transient acceleration of the robot on an axis z when the robot is in the moving state as the elevator moves. Acceleration of the robot on three axes x, y, and z may be obtained by using the acceleration sensor. The starting story number may be set by a user of the robot. For example, if the robot is on the third story when starting to take the elevator, the starting story number of the robot is set to 3. For the story height of each story, the robot may be placed in the elevator in advance, and the elevator stops on each story when moving, to calculate displacement and record the story height of each story.

The gravity acceleration of the robot in the static state may be obtained by calculating an average gravity acceleration value of multiple gravity acceleration values of the robot in the static state in the elevator that are detected by using the acceleration sensor of the robot. The average gravity acceleration value is used as the gravity acceleration of the robot in the static state.

In an exemplary embodiment, the story monitoring method when a robot takes an elevator is applied to the electronic device shown in FIG. 2 further includes Step 304: Subtract the gravity acceleration of the robot in the static state from the transient acceleration of the robot in the moving state to obtain an acceleration change waveform of the robot.

In this exemplary embodiment, a transient acceleration value of the robot in the moving state is detected by using the acceleration sensor of the robot.

In an exemplary embodiment, the story monitoring method when a robot takes an elevator is applied to the electronic device shown in FIG. 2 further includes Step 306: Compare the acceleration change waveform by using an acceleration waveform classifier of the elevator, to obtain an acceleration waveform classifier to which the acceleration change waveform belongs, obtain a configured state machine and a conversion relationship between different movement statuses in the state machine, determine a moving direction of the elevator according to the conversion relationship and a next acceleration waveform classifier adjacent to an acceleration static waveform classifier, and obtain a movement status of the elevator at each moment according to a correspondence between the acceleration waveform classifier and a movement status of the elevator and the moving direction of the elevator.

In this exemplary embodiment, the step of comparing the acceleration change waveform by using an acceleration waveform classifier of the elevator, to obtain an acceleration waveform classifier to which the acceleration change waveform belongs includes: comparing a waveform of the acceleration waveform classifier of the elevator with the acceleration change waveform; obtaining a waveform of the acceleration waveform classifier whose distance to the acceleration change waveform is the shortest; and using the acceleration waveform classifier whose distance is the shortest as the acceleration waveform classifier to which the acceleration change waveform belongs.

Specifically, the acceleration waveform classifier of the elevator is an acceleration waveform classifier obtained by performing training on acceleration waveform data that is prerecorded when the robot is in the elevator during ascending and descending.

Figure 6:
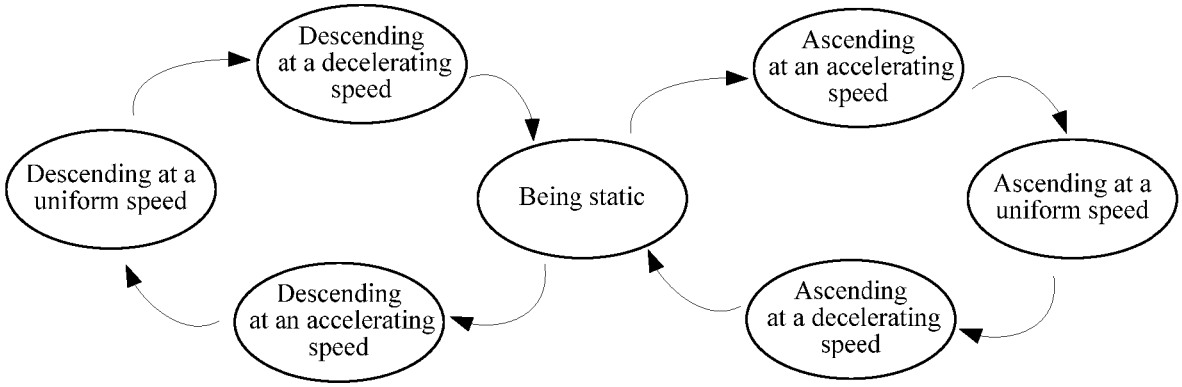
FIG. 6 is a schematic diagram of a conversion relationship between statuses of a state machine of an elevator according to an exemplary embodiment.

A speed status in the configured state machine includes: being static, ascending at an accelerating speed, ascending at a uniform speed, ascending at a decelerating speed, descending at an accelerating speed, descending at a uniform speed, and descending at a decelerating speed; and the conversion relationship between the different statuses includes conversion between adjacent movement statuses from being static, to ascending at an accelerating speed, to ascending at a uniform speed, and to ascending at a decelerating speed, and conversion between adjacent movement statuses from being static, to descending at an accelerating speed, to descending at a uniform speed, and to descending at a decelerating speed, as shown in FIG. 6.

An obtained next acceleration waveform classifier adjacent to an acceleration static waveform classifier is DOWN_START, DOWN_BEING, and DOWN_END. According to the conversion relationship between different movement statuses in the state machine of the elevator, being static can convert only to descending at an accelerating speed or ascending at an accelerating speed. Therefore, the next acceleration waveform classifier adjacent to the static waveform classifier is DOWN_START, DOWN_BEING, and DOWN_END, and the moving direction of the elevator is downward.

An obtained next acceleration waveform classifier adjacent to an acceleration static waveform classifier is UP_START, UP_BEING, and UP_END. According to the conversion relationship between different movement statuses in the state machine of the elevator, being static can convert only to descending at an accelerating speed or ascending at an accelerating speed. Therefore, the next acceleration waveform classifier adjacent to the static waveform classifier is UP_START, UP_BEING, and UP_END, and the moving direction of the elevator is upward.

Referring back to FIG. 3, in an exemplary embodiment, the story monitoring method when a robot takes an elevator is applied to the electronic device shown in FIG. 2 further includes Step 308: Obtain transient acceleration and a total time of the elevator in a complete movement status, obtain an instantaneous speed of the elevator according to the transient acceleration, and then obtain actual displacement of the elevator according to the instantaneous speed and the total time of the elevator, the complete movement status including a process of a static state, to an accelerating state, to a uniform speed state, to a decelerating state, and to a static state.

In this exemplary embodiment, according to the acceleration law $v_t=v_0+at$, the instantaneous speed of the elevator may be calculated by means of an initial speed, the transient acceleration, and a time period, and then the actual displacement of the elevator is calculated according to a relationship $s=\int v_t dt$ between a speed and displacement. The movement status refers to a speed status.

Figure 4:
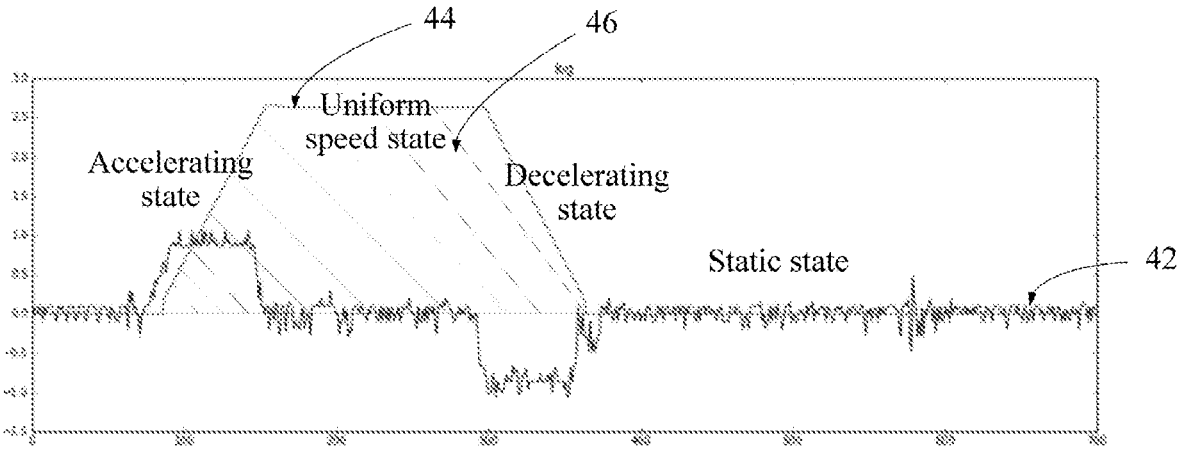
FIG. 4 is a schematic diagram of acceleration, an actual speed, and displacement of an elevator during ascending according to an exemplary embodiment.

FIG. 4 is a schematic diagram of acceleration, an actual speed, and displacement of an elevator during ascending according to an exemplary embodiment. As shown in FIG. 4, 42 (a burr line) represents the transient acceleration, 44 (a smooth straight line) represents the actual speed, and 46 (an area of a part with slanting lines) represents the displacement. The actual speed includes a static phase, an accelerating phase, a uniform speed phase, a decelerating phase, and a static phase. A horizontal coordinate represents a time, and a vertical coordinate represents a value obtained by subtracting acceleration in a moving state from gravity acceleration in a static state. An acceleration curve of the elevator during descending and an acceleration curve of the elevator during ascending are symmetrical.

Referring back to FIG. 3, in an exemplary embodiment, the story monitoring method when a robot takes an elevator is applied to the electronic device shown in FIG. 2 further includes Step 310: Obtain a story that the elevator is on after a complete movement status according to the actual displacement of the elevator, the starting story number, and the story height of each story.

In this exemplary embodiment, the story that the elevator is on is obtained according to the actual displacement s of the elevator, the starting story number n, and the story height of each story.

According to the foregoing story monitoring method when a robot takes an elevator, gravity acceleration of the robot in a static state in the elevator and transient acceleration of the robot in a moving state in the elevator are obtained, to obtain an acceleration change waveform; an acceleration waveform classifier of the elevator is used to compare the acceleration change waveform, to obtain an acceleration waveform classifier to which the acceleration change waveform belongs; a movement status of the elevator at each moment is obtained according to a correspondence between the acceleration waveform classifier and a movement status of the elevator; and then transient acceleration and a total time of the elevator in a complete movement status are obtained, to calculate the actual displacement. The story that the elevator is on, that is, the story that the robot is on, is obtained according to the actual displacement, the starting story number, and the story height of each story, thereby implementing monitoring stories that the robot is on when the robot takes various elevators.

In an exemplary embodiment, before the obtaining gravity acceleration of a robot in a static state in an elevator and transient acceleration of the robot in a moving state, a starting story number, and a story height of each story, the foregoing story monitoring method when a robot takes an elevator further includes: placing the robot in the elevator, and recording an acceleration waveform of the elevator during ascending and descending; cutting the recorded acceleration waveform into multiple different acceleration state sample training sets; cutting the recorded acceleration waveform into multiple different acceleration state sample training sets; and obtaining displacement of each story, and marking the story height of each story.

In this exemplary embodiment, the acceleration waveform is cut into seven different acceleration state sample training sets. The acceleration waveform classifier is obtained by training samples in the sample training sets by means of linear regression. In a process of obtaining a story height of each story, each time the elevator moves to a story, the elevator stops to record displacement of the story, to obtain the story height of each story.

Figure 5:
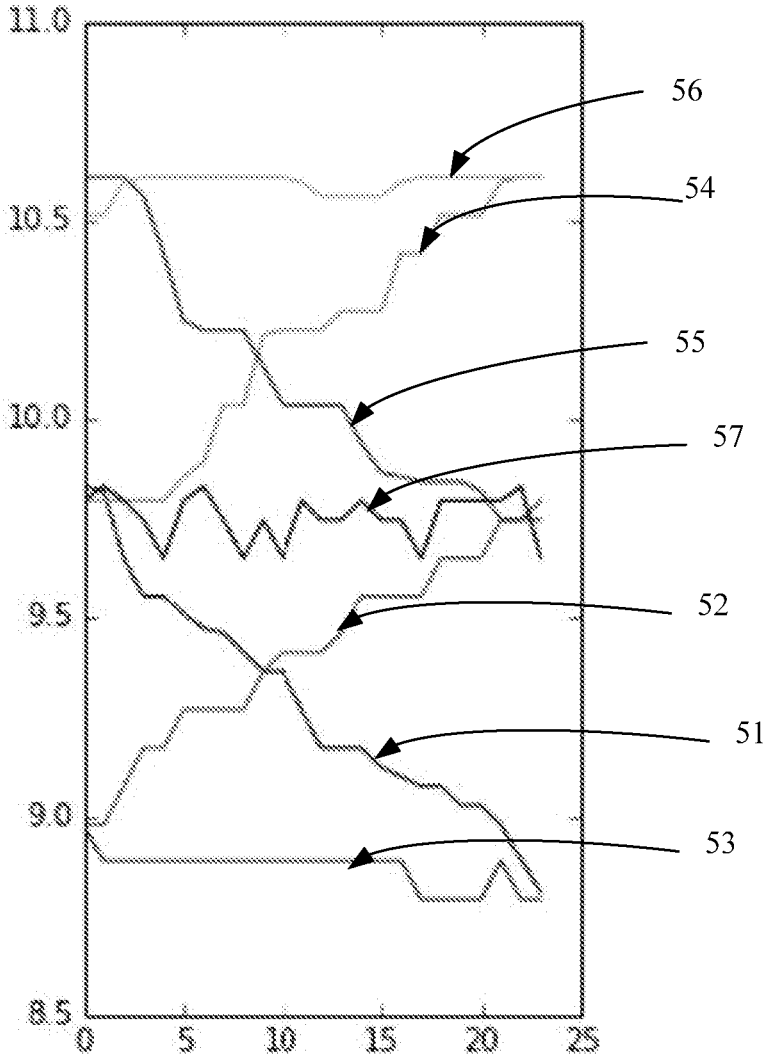
FIG. 5 shows seven line segments corresponding to seven different acceleration waveform classifiers according to an exemplary embodiment.

FIG. 5 shows seven line segments corresponding to seven different acceleration waveform classifiers according to an exemplary embodiment. As shown in FIG. 5, each line segment corresponds to a time window. A time period of the time window is 1 s, and a corresponding frame number is 24. A horizontal coordinate represents a time, and a vertical coordinate represents an acceleration value. 51 represents DOWN_START (starting descending), 52 represents DOWN_END (stopping descending), 53 represents DOWN_BEING (being descending), 54 represents UP_START (starting ascending), 55 represents UP_END (stopping ascending), 56 represents UP_BEING (being ascending), and 57 represents NORMAL_BEING (moving in a uniform speed or being in a static state).

According to one or more exemplary embodiments, a status in a state machine configured for an elevator includes: being static, ascending at an accelerating speed, ascending at a uniform speed, ascending at a decelerating speed, descending at an accelerating speed, descending at a uniform speed, and descending at a decelerating speed. A conversion relationship between the different movement statuses includes conversion between adjacent movement statuses from being static, to ascending at an accelerating speed, to ascending at a uniform speed, and to ascending at a decelerating speed, and conversion between adjacent movement statuses from being static, to descending at an accelerating speed, to descending at a uniform speed, and to descending at a decelerating speed. During ascending, being static can convert only to ascending at an accelerating speed, ascending at an accelerating speed converts to ascending at a uniform speed, ascending at a uniform speed converts to ascending at a decelerating speed, and ascending at a decelerating speed converts to being static. During descending, being static can convert only to descending at an accelerating speed, descending at an accelerating speed converts to descending at a uniform speed, descending at a uniform speed converts to descending at a decelerating speed, and descending at a decelerating speed converts to being static. As shown in FIG. 6, a movement status in a state machine of an elevator includes: being static, ascending at an accelerating speed, ascending at a uniform speed, ascending at a decelerating speed, descending at an accelerating speed, descending at a uniform speed, and descending at a decelerating speed. A chronological order of conversion between the different statuses is shown by means of arrows.

A correspondence between the acceleration waveform classifiers and movement statuses of the elevator may be:

Descending at an accelerating speed corresponds to DOWN_START, DOWN_BEING, and DOWN_END.

Descending at a uniform speed corresponds to NORMAL_BEING.

Descending at a decelerating speed corresponds to UP_START, UP_BEING, and UP_END.

Ascending at an accelerating speed corresponds to UP_START, UP_BEING, and UP_END.

Ascending at a uniform speed corresponds to NORMAL_BEING.

Ascending at a decelerating speed corresponds to DOWN_START, DOWN_BEING, and DOWN_END.

Being static corresponds to NORMAL_BEING.

An acceleration change waveform is classified according to an acceleration waveform classifier, to obtain an acceleration waveform classifier to which the acceleration change waveform belongs. Different acceleration waveform classifiers to which different acceleration change waveforms belong are compared according to the correspondence between movement statuses and acceleration classifiers, to obtain corresponding movement statuses.

Figure 7:
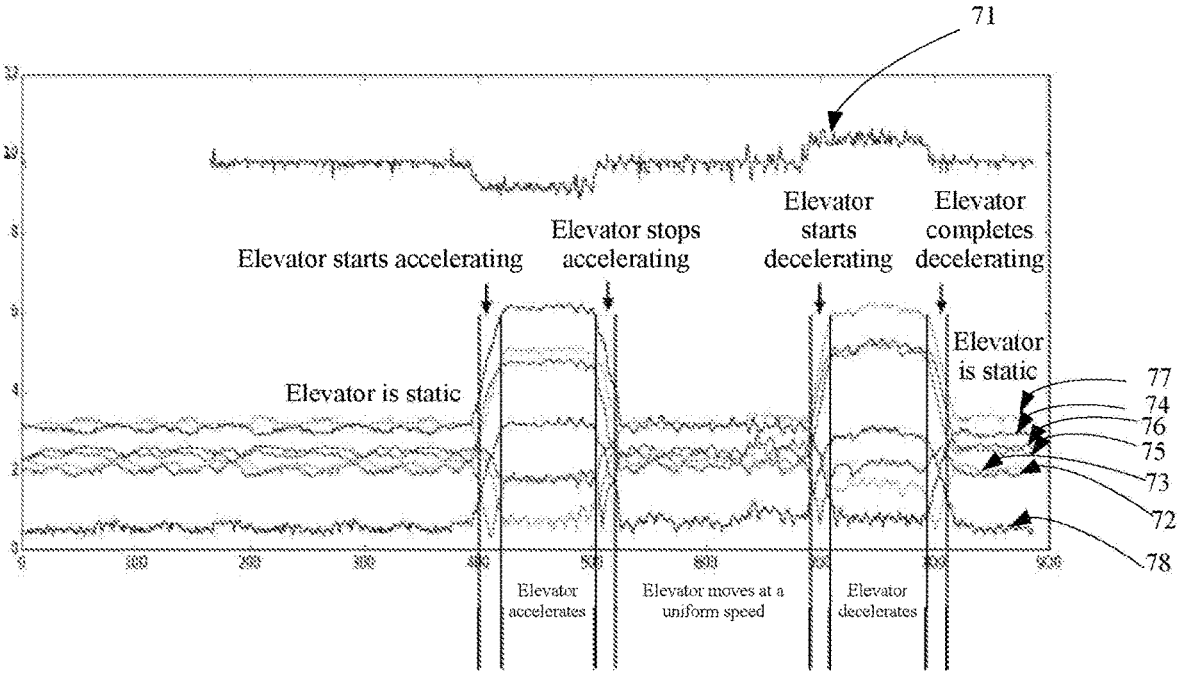
FIG. 7 is a schematic diagram of a prediction result of a movement status according to an exemplary embodiment.

FIG. 7 is a schematic diagram of a prediction result of a movement status according to one or more exemplary embodiments. As shown in FIG. 7, a movement status of an elevator includes: being static, starting accelerating, accelerating, stopping accelerating, moving at a uniform speed, starting decelerating, decelerating, completing decelerating, and being static. 71 represents an input transient acceleration waveform when the elevator moves downward. 72 represents an acceleration change waveform obtained by subtracting a transient acceleration waveform from gravity acceleration, that is, a distance curve, and is closest to UP_START (starting ascending). 73 represents an acceleration change waveform obtained by subtracting a transient acceleration waveform from gravity acceleration, that is, a distance curve, and is closest to UP_END (stopping ascending). 74 represents an acceleration change waveform obtained by subtracting a transient acceleration waveform from gravity acceleration, that is, a distance curve, and is closest to UP_BEING (being ascending). 75 represents an acceleration change waveform obtained by subtracting a transient acceleration waveform from gravity acceleration, that is, a distance curve, and is closest to DOWN_START (starting descending). 76 represents an acceleration change waveform obtained by subtracting a transient acceleration waveform from gravity acceleration, that is, a distance curve, and is closest to DOWN_END (stopping descending). 77 represents an acceleration change waveform obtained by subtracting a transient acceleration waveform from gravity acceleration, that is, a distance curve, and is closest to DOWN_BEING (being descending). 78 represents an acceleration change waveform obtained by subtracting a transient acceleration waveform from gravity acceleration, that is, a distance curve, and is closest to NORMAL_BEING (moving at a uniform speed or being in a static state). Being closest to an acceleration waveform classifier is being similar to the acceleration waveform classifier to the most degree.

In an exemplary embodiment, after the step of comparing the acceleration change waveform by using an acceleration waveform classifier of the elevator, to obtain an acceleration waveform classifier to which the acceleration change waveform belongs, and a movement status of the elevator at each moment according to a correspondence between the acceleration waveform classifier and a movement status of the elevator, the story monitoring method when a robot takes an elevator further includes: detecting whether the movement status of the elevator at each moment satisfies a conversion relationship between different configured states; and if the conversion relationship between different configured movement statuses is satisfied, converting, by the movement status of the elevator, from a movement status in the configured state machine to a next movement status.

A speed status in the configured state machine includes: being static, ascending at an accelerating speed, ascending at a uniform speed, ascending at a decelerating speed, descending at an accelerating speed, descending at a uniform speed, and descending at a decelerating speed; and the conversion relationship between the different statuses includes conversion between adjacent movement statuses from being static, to ascending at an accelerating speed, to ascending at a uniform speed, and to ascending at a decelerating speed, and conversion between adjacent movement statuses from being static, to descending at an accelerating speed, to descending at a uniform speed, and to descending at a decelerating speed.

In this exemplary embodiment, for the conversion relationship between the configured different statuses, for example, descending at a uniform speed can convert only to descending at a decelerating speed, and cannot convert to being static. When a movement status of the elevator is descending at a uniform speed, if it is detected that the movement status of the elevator is descending at a decelerating speed after an acceleration waveform classifier to which an acceleration change waveform belongs is obtained by means of comparison according to the acceleration waveform classifier, the movement status in the state machine converts to descending at a decelerating speed. Based on the state machine, the movement status of the elevator itself can be maintained, so as to avoid that the entire detection is affected by some peak errors, thereby improving robustness of the entire detection.

The following describes a specific implementation process of the foregoing story monitoring method when a robot takes an elevator with reference to a specific application scenario. For example, a starting story number when the robot takes the elevator is 3, and a story height of each story is 3 m. The robot is in the elevator. Gravity acceleration in a static state is 9.8 $N/m^2$. When the elevator moves, acceleration of the elevator in a moving state is monitored by using an acceleration sensor installed in the robot. An acceleration change waveform is obtained by calculating a difference between the acceleration and the gravity acceleration. The acceleration change waveform is compared with an acceleration waveform classifier, to determine an acceleration waveform classifier to which the acceleration change waveform belongs. Then, a movement status of the elevator is obtained according to a correspondence between the acceleration waveform classifier and a movement status of the elevator. Next, an acceleration value at each moment and a total time of the elevator in a complete movement status is obtained, so as to calculate actual displacement of the elevator. For example, the actual displacement of the elevator is 12 m. A value obtained by dividing 12 m by 3 m is 4, the starting story number is 3, and therefore a current story number obtained by adding 3 and 4 is 7.

Figure 8:
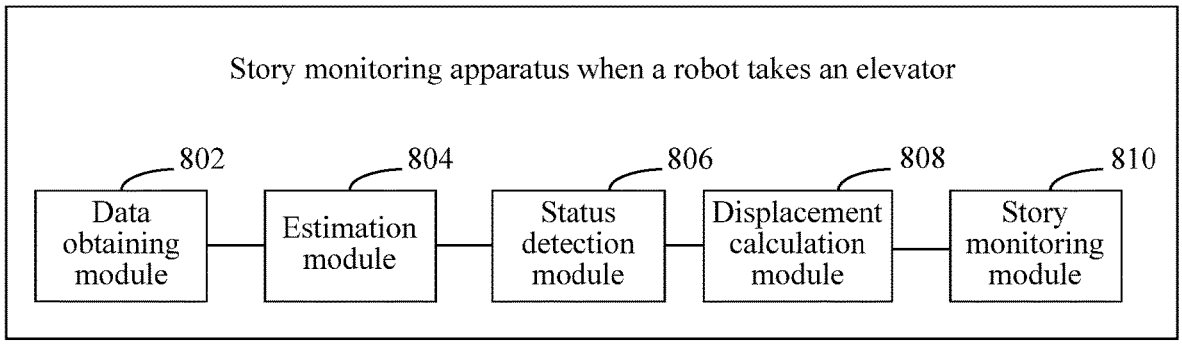
FIG. 8 is a structural block diagram of a story monitoring apparatus when a robot takes an elevator according to an exemplary embodiment.

FIG. 8 is a structural block diagram of a story monitoring apparatus when a robot takes an elevator according to an exemplary embodiment. As shown in FIG. 8, the story monitoring apparatus when a robot takes an elevator includes a data obtaining module 802, an estimation module 804, a status detection module 806, a displacement calculation module 808, and a story monitoring module 810.

The data obtaining module 802 is configured to obtain gravity acceleration of the robot in a static state in the elevator and transient acceleration of the robot in a moving state in the elevator, a starting story number, and a story height of each story.

In this exemplary embodiment, an acceleration sensor in the robot can detect transient acceleration of the robot on an axis z when the robot is in the moving state as the elevator moves. Acceleration of the robot on three axes x, y, and z may be obtained by using the acceleration sensor. The starting story number may be set by a user of the robot. For example, if the robot is on the third story when starting to take the elevator, the starting story number of the robot is set to 3. For the story height of each story, the robot may be placed in the elevator in advance, and the elevator stops on each story when moving, to calculate displacement and record the story height of each story.

The data obtaining module 802 is further configured to calculate an average gravity acceleration value of multiple gravity acceleration values that are of the robot in the static state in the elevator and that are detected by using the acceleration sensor of the robot. The average gravity acceleration value is used as the gravity acceleration of the robot in the static state.

The estimation module 804 is configured to subtract the gravity acceleration of the robot in the static state from the transient acceleration of the robot in the moving state to obtain an acceleration change waveform of the robot.

The status detection module 806 is configured to: compare the acceleration change waveform by using an acceleration waveform classifier of the elevator, to obtain an acceleration waveform classifier to which the acceleration change waveform belongs, obtain a configured state machine and a conversion relationship between different movement statuses in the state machine, determine a moving direction of the elevator according to the conversion relationship and a next acceleration waveform classifier adjacent to an acceleration static waveform classifier, and obtain a movement status of the elevator at each moment according to a correspondence between the acceleration waveform classifier and a movement status of the elevator and the moving direction of the elevator.

In this exemplary embodiment, the status detection module 806 compares a waveform of the acceleration waveform classifier of the elevator with the acceleration change waveform; obtains a waveform of the acceleration waveform classifier whose distance to the acceleration change waveform is the shortest; and uses the acceleration waveform classifier whose distance is the shortest as the acceleration waveform classifier to which the acceleration change waveform belongs.

Specifically, the acceleration waveform classifier of the elevator is an acceleration waveform classifier obtained by performing training on acceleration waveform data that is prerecorded when the robot is in the elevator during ascending and descending.

The displacement calculation module 808 is configured to: obtain transient acceleration and a total time of the elevator in a complete movement status, obtain an instantaneous speed of the elevator according to the transient acceleration, and then obtain actual displacement of the elevator according to the instantaneous speed and the total time of the elevator, the complete movement status including a process of a static state, to an accelerating state, to a uniform speed state, to a decelerating state, and to a static state.

In this exemplary embodiment, according to the acceleration law $v_t=v_0+at$, the instantaneous speed of the elevator may be calculated by means of an initial speed, the transient acceleration, and a time period, and then the actual displacement of the elevator is calculated according to a relationship $s=\int v_t dt$ between a speed and displacement. The movement status refers to a speed status.

The story monitoring module 810 is configured to obtain a story that the elevator is on after a complete movement status according to the actual displacement of the elevator, the starting story number, and the story height of each story.

According to the foregoing story monitoring apparatus when a robot takes an elevator, gravity acceleration of the robot in a static state in the elevator and transient acceleration of the robot in a moving state in the elevator are obtained, to obtain an acceleration change waveform; an acceleration waveform classifier of the elevator is used to compare the acceleration change waveform, to obtain an acceleration waveform classifier to which the acceleration change waveform belongs; a movement status of the elevator at each moment is obtained according to a correspondence between the acceleration waveform classifier and a movement status of the elevator; and then transient acceleration and a total time of the elevator in a complete movement status are obtained, to calculate the actual displacement. The story that the elevator is on, that is, the story that the robot is on, is obtained according to the actual displacement, the starting story number, and the story height of each story, thereby implementing monitoring stories that the robot is on when the robot takes various elevators.

Figure 9:
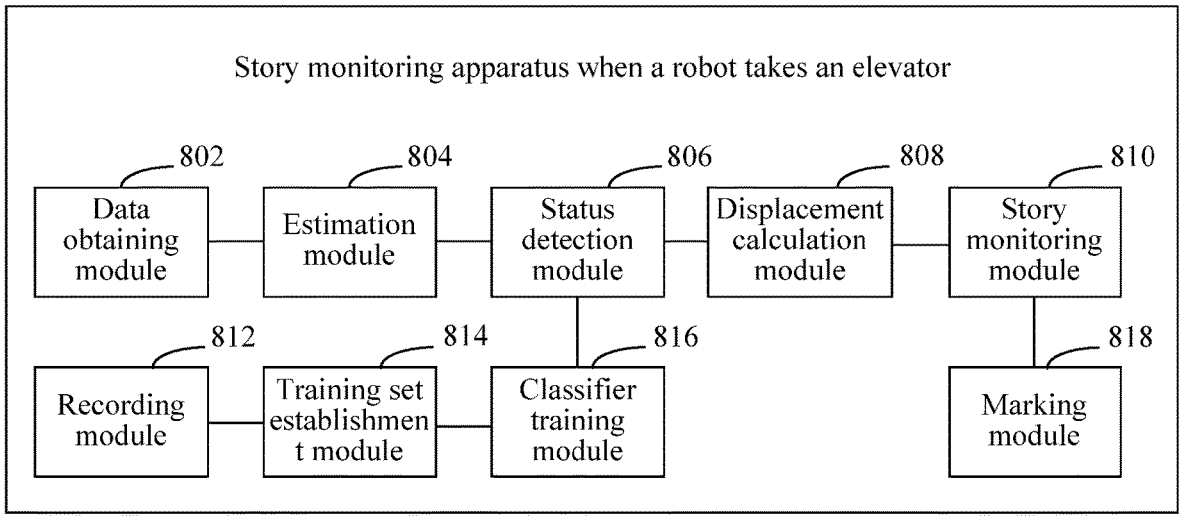
FIG. 9 is a structural block diagram of a story monitoring apparatus when a robot takes an elevator according to another exemplary embodiment.

FIG. 9 is a structural block diagram of a story monitoring apparatus when a robot takes an elevator according to another exemplary embodiment. As shown in FIG. 9, the story monitoring apparatus when a robot takes an elevator includes a data obtaining module 802, an estimation module 804, a status detection module 806, a displacement calculation module 808, and a story monitoring module 810, and also includes a recording module 812, a training set establishment module 814, a classifier training module 816, and a marking module 818.

The recording module 812 is configured to: before gravity acceleration of the robot in a static state in the elevator and transient acceleration of the robot in a moving state in the elevator, a starting story number, and a story height of each story are obtained, place the robot in the elevator, and record an acceleration waveform of the elevator during ascending and descending.

The training set establishment module 814 is configured to cut the recorded acceleration waveform into multiple different acceleration state sample training sets.

The classifier training module 816 is configured to obtain an acceleration waveform classifier by performing training according to the sample training set.

The marking module 818 is configured to obtain displacement of each story and mark the story height of each story.

Figure 10:
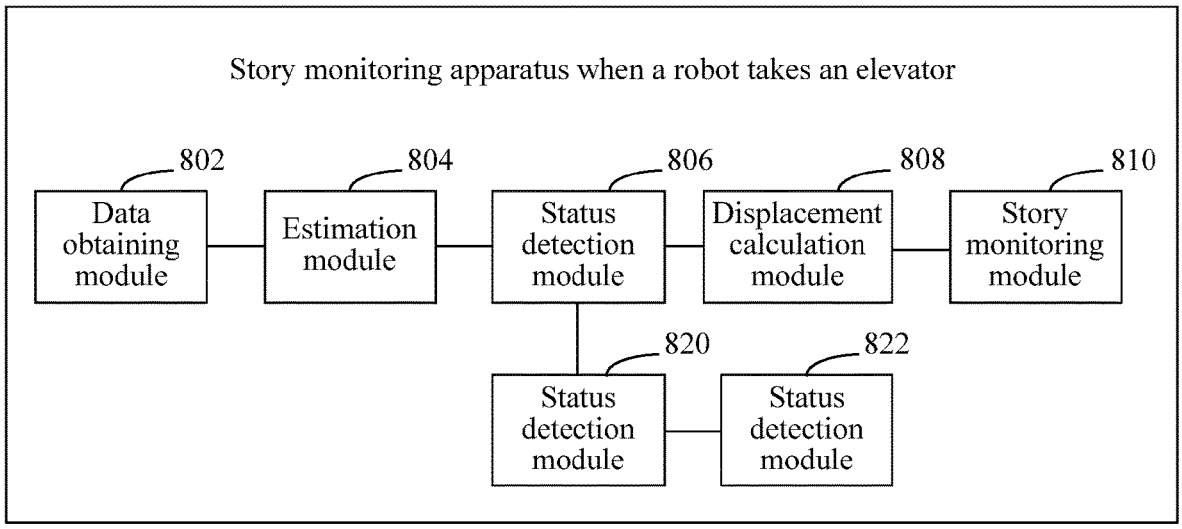
FIG. 10 is a structural block diagram of a story monitoring apparatus when a robot takes an elevator according to another exemplary embodiment.

FIG. 10 is a structural block diagram of a story monitoring apparatus when a robot takes an elevator according to another exemplary embodiment. As shown in FIG. 10, the story monitoring apparatus when a robot takes an elevator includes a data obtaining module 802, an estimation module 804, a status detection module 806, a displacement calculation module 808, and a story monitoring module 810, and also includes a detection module 820 and a status updating module 822.

The detection module 820 is configured to: after an acceleration change waveform is compared by using an acceleration waveform classifier of the elevator, to obtain an acceleration waveform classifier to which the acceleration change waveform belongs, and a movement status of the elevator at each moment is obtained according to a correspondence between the acceleration waveform classifier and a movement status of the elevator, detect whether the movement status of the elevator at each moment satisfies a conversion relationship between different configured states.

The status updating module 822 is configured to: if the conversion relationship between different configured movement statuses is satisfied, convert, by the movement status of the elevator, from a movement status in the configured state machine to a next movement status.

A status in the configured state machine includes: being static, ascending at an accelerating speed, ascending at a uniform speed, ascending at a decelerating speed, descending at an accelerating speed, descending at a uniform speed, and descending at a decelerating speed; and the conversion relationship between the different statuses includes conversion between adjacent movement statuses from being static, to ascending at an accelerating speed, to ascending at a uniform speed, and to ascending at a decelerating speed, and conversion between adjacent movement statuses from being static, to descending at an accelerating speed, to descending at a uniform speed, and to descending at a decelerating speed.

In another exemplary embodiment, the story monitoring apparatus when a robot takes an elevator may include any possible combination of the data obtaining module 802, the estimation module 804, the status detection module 806, the displacement calculation module 808, and the story monitoring module 810, and the recording module 812, the training set establishment module 814, the classifier training module 816, the marking module 818, the detection module 820, and the status updating module 822.

A person of ordinary skill in the art may understand that all or some of the processes of the methods in the foregoing embodiments may be implemented by a computer program instructing relevant hardware. The program may be stored in a non-volatile computer-readable storage medium. When the program runs, the processes of the foregoing method embodiments may be included. The storage medium may be a magnetic disc, an optical disc, a read-only memory (ROM), or the like.

The foregoing embodiments show only several implementations of the present disclosure and are described in detail, but they should not be construed as a limitation to the patent scope of the present disclosure. It should be noted that, a person of ordinary skill in the technology may make various changes and improvements without departing from the ideas of the present disclosure, which shall fall within the protection scope of the present disclosure. Therefore, the protection scope of the patent of the present disclosure shall be subject to the claims.

What is claimed is:

1. A story monitoring method when a robot takes an elevator, comprising:

obtaining gravity acceleration of a robot in a static state in an elevator and transient acceleration of the robot in a moving state in the elevator, a starting story number, and a story height of each story;

subtracting the gravity acceleration of the robot in the static state from the transient acceleration of the robot in the moving state to obtain an acceleration change waveform of the robot;

comparing the acceleration change waveform to an acceleration waveform classifier grouping corresponding to the elevator, to obtain an acceleration waveform classifier to which the acceleration change waveform belongs, obtaining a configured state machine and a conversion relationship between different movement statuses in the state machine, determining a moving direction of the elevator according to the conversion relationship and a next acceleration waveform classifier adjacent to an acceleration static waveform classifier, and obtaining a movement status of the elevator at each moment according to a correspondence between the acceleration waveform classifier and a movement status of the elevator and the moving direction of the elevator;

obtaining actual displacement of the elevator in a complete movement status of the elevator, the complete movement status comprising a process of a static state, to an accelerating state, to a uniform speed state, to a decelerating state, and to a static state; and obtaining a story that the elevator is on after a complete movement status according to the actual displacement of the elevator, the starting story number, and the story height of each story.

2. The method according to claim 1, wherein before the obtaining gravity acceleration of a robot in a static state in an elevator and transient acceleration of the robot in a moving state in the elevator, a starting story number, and a story height of each story, the method further comprises:

placing the robot in the elevator, and recording an acceleration waveform of the elevator during ascending and descending;

cutting the recorded acceleration waveform into multiple different acceleration state sample training sets;

cutting the recorded acceleration waveform into multiple different acceleration state sample training sets; and obtaining displacement of each story, and marking the story height of each story.

3. The method according to claim 1, wherein the comparing the acceleration change waveform by using an acceleration waveform classifier of the elevator, to obtain an acceleration waveform classifier to which the acceleration change waveform belongs comprises:

comparing a waveform of the acceleration waveform classifier of the elevator with the acceleration change waveform;

obtaining a waveform of the acceleration waveform classifier whose distance to the acceleration change waveform is the shortest; and using the acceleration waveform classifier whose distance is the shortest as the acceleration waveform classifier to which the acceleration change waveform belongs.

4. The method according to claim 1, wherein after the comparing the acceleration change waveform by using an acceleration waveform classifier of the elevator, to obtain an acceleration waveform classifier to which the acceleration change waveform belongs, and a movement status of the elevator at each moment according to a correspondence between the acceleration waveform classifier and a movement status of the elevator, the method further comprises:

detecting whether the movement status of the elevator at each moment satisfies a conversion relationship between different configured states; and if the conversion relationship between different configured movement statuses is satisfied, converting, by the movement status of the elevator, from a movement status in the configured state machine to a next movement status.

5. The method according to claim 4, wherein the movement status comprises one of: being static, ascending at an accelerating speed, ascending at a uniform speed, ascending at a decelerating speed, descending at an accelerating speed, descending at a uniform speed, and descending at a decelerating speed; and the conversion relationship between the different movement statuses comprises one of: being static to ascending at an accelerating speed, ascending at an accelerating speed to ascending at a uniform speed, ascending at a uniform speed to ascending at a decelerating speed, being static to descending at an accelerating speed, descending at an accelerating speed to descending at a uniform speed, and descending at a uniform speed to descending at a decelerating speed.

6. The method according to claim 1, wherein the obtaining actual displacement of the elevator in a complete movement status of the elevator further comprises:

obtaining transient acceleration and a total time of the elevator in a complete movement status, obtaining an instantaneous speed of the elevator according to the transient acceleration, and then obtaining the actual displacement of the elevator according to the instantaneous speed and the total time of the elevator.

7. An electronic device, comprising:

at least one memory configured to store computer program code; and at least one processor configured to access said memory, read said computer program code, and operate as instructed by said computer program code, said computer program code including:

obtaining code configured to cause said at least one processor to obtain gravity acceleration of a robot in a static state in an elevator and transient acceleration of the robot in a moving state in the elevator, a starting story number, and a story height of each story;

subtracting code configured to cause said at least one processor to subtract the gravity acceleration of the robot in the static state from the transient acceleration of the robot in the moving state to obtain an acceleration change waveform of the robot;

comparing code configured to cause said at least one processor to compare the acceleration change waveform to an acceleration waveform classifier grouping corresponding to the elevator, to obtain an acceleration waveform classifier to which the acceleration change waveform belongs, obtain a configured state machine and a conversion relationship between different movement statuses in the state machine, determine a moving direction of the elevator according to the conversion relationship and a next acceleration waveform classifier adjacent to an acceleration static waveform classifier, and obtain a movement status of the elevator at each moment according to a correspondence between the acceleration waveform classifier and a movement status of the elevator and the moving direction of the elevator;

obtaining actual displacement code configured to cause said at least one processor to obtain actual displacement of the elevator in a complete movement status of the elevator, the complete movement status comprising a process of a static state, to an accelerating state, to a uniform speed state, to a decelerating state, and to a static state; and obtaining a story code configured to cause said at least one processor to obtain a story that the elevator is on after a complete movement status according to the actual displacement of the elevator, the starting story number, and the story height of each story.

8. The electronic device according to claim 7, wherein before the obtaining gravity acceleration of a robot in a static state in an elevator and transient acceleration of the robot in a moving state in the elevator, a starting story number, and a story height of each story, the processor is further configured to perform:

placing the robot in the elevator, and recording an acceleration waveform of the elevator during ascending and descending;

cutting the recorded acceleration waveform into multiple different acceleration state sample training sets;

performing training according to the sample training set to obtain the acceleration waveform classifier; and obtaining displacement of each story, and marking the story height of each story.

9. The electronic device according to claim 7, wherein the comparing the acceleration change waveform by using an acceleration waveform classifier of the elevator, to obtain an acceleration waveform classifier to which the acceleration change waveform belongs further comprises:

comparing a waveform of the acceleration waveform classifier of the elevator with the acceleration change waveform;

obtaining a waveform of the acceleration waveform classifier whose distance to the acceleration change waveform is the shortest; and using the acceleration waveform classifier whose distance is the shortest as the acceleration waveform classifier to which the acceleration change waveform belongs.

10. The electronic device according to claim 7, wherein after the comparing the acceleration change waveform by using an acceleration waveform classifier of the elevator, to obtain an acceleration waveform classifier to which the acceleration change waveform belongs, and a movement status of the elevator at each moment according to a correspondence between the acceleration waveform classifier and a movement status of the elevator, the processor is further configured to perform:

detecting whether the movement status of the elevator at each moment satisfies a conversion relationship between different configured states; and if the conversion relationship between different configured movement statuses is satisfied, converting, by the movement status of the elevator, from a movement status in the configured state machine to a next movement status.

11. The electronic device according to claim 10, wherein the movement status comprises one of: being static, ascending at an accelerating speed, ascending at a uniform speed, ascending at a decelerating speed, descending at an accelerating speed, descending at a uniform speed, and descending at a decelerating speed; and the conversion relationship between the different movement statuses comprises one of: being static to ascending at an accelerating speed, ascending at an accelerating speed to ascending at a uniform speed, ascending at a uniform speed to ascending at a decelerating speed, being static to descending at an accelerating speed, descending at an accelerating speed to descending at a uniform speed, and descending at a uniform speed to descending at a decelerating speed.

12. The electronic device according to claim 7, wherein the obtaining actual displacement of the elevator in a complete movement status of the elevator further comprises:

obtaining transient acceleration and a total time of the elevator in a complete movement status, obtaining an instantaneous speed of the elevator according to the transient acceleration, and then obtaining the actual displacement of the elevator according to the instantaneous speed and the total time of the elevator.

13. One or more non-volatile computer readable storage media comprising computer executable instructions that, when executed by one or more processors, the computer executable instructions cause the processors to perform:

obtaining gravity acceleration of a robot in a static state in an elevator and transient acceleration of the robot in a moving state in the elevator, a starting story number, and a story height of each story;

subtracting the gravity acceleration of the robot in the static state from the transient acceleration of the robot in the moving state to obtain an acceleration change waveform of the robot;

comparing the acceleration change waveform to an acceleration waveform classifier grouping corresponding to the elevator, to obtain an acceleration waveform classifier to which the acceleration change waveform belongs, obtaining a configured state machine and a conversion relationship between different movement statuses in the state machine, determining a moving direction of the elevator according to the conversion relationship and a next acceleration waveform classifier adjacent to an acceleration static waveform classifier, and obtaining a movement status of the elevator at each moment according to a correspondence between the acceleration waveform classifier and a movement status of the elevator and the moving direction of the elevator;

obtaining actual displacement of the elevator in a complete movement status of the elevator, the complete movement status comprising a process of a static state, to an accelerating state, to a uniform speed state, to a decelerating state, and to a static state; and obtaining a story that the elevator is on after a complete movement status according to the actual displacement of the elevator, the starting story number, and the story height of each story.

14. The non-volatile computer readable storage media according to claim 13, wherein before the obtaining gravity acceleration of a robot in a static state in an elevator and transient acceleration of the robot in a moving state in the elevator, a starting story number, and a story height of each story, the processor is further configured to perform:

placing the robot in the elevator, and recording an acceleration waveform of the elevator during ascending and descending;

cutting the recorded acceleration waveform into multiple different acceleration state sample training sets;

performing training according to the sample training set to obtain the acceleration waveform classifier; and obtaining displacement of each story, and marking the story height of each story.

15. The non-volatile computer readable storage media according to claim 13, wherein the comparing the acceleration change waveform by using an acceleration waveform classifier of the elevator, to obtain an acceleration waveform classifier to which the acceleration change waveform belongs further comprises:

comparing a waveform of the acceleration waveform classifier of the elevator with the acceleration change waveform;

obtaining a waveform of the acceleration waveform classifier whose distance to the acceleration change waveform is the shortest; and using the acceleration waveform classifier whose distance is the shortest as the acceleration waveform classifier to which the acceleration change waveform belongs.

16. The non-volatile computer readable storage media according to claim 13, wherein after the comparing the acceleration change waveform by using an acceleration waveform classifier of the elevator, to obtain an acceleration waveform classifier to which the acceleration change waveform belongs, and a movement status of the elevator at each moment according to a correspondence between the acceleration waveform classifier and a movement status of the elevator, the processor is further configured to perform:

detecting whether the movement status of the elevator at each moment satisfies a conversion relationship between different configured states; and if the conversion relationship between different configured movement statuses is satisfied, converting, by the movement status of the elevator, from a movement status in the configured state machine to a next movement status.

17. The non-volatile computer readable storage media according to claim 16, wherein the movement status comprises one of: being static, ascending at an accelerating speed, ascending at a uniform speed, ascending at a decelerating speed, descending at an accelerating speed, descending at a uniform speed, and descending at a decelerating speed; and the conversion relationship between the different movement statuses comprises one of: being static to ascending at an accelerating speed, ascending at an accelerating speed to ascending at a uniform speed, ascending at a uniform speed to ascending at a decelerating speed, being static to descending at an accelerating speed, descending at an accelerating speed to descending at a uniform speed, and descending at a uniform speed to descending at a decelerating speed.

18. The non-volatile computer readable storage media according to claim 13, wherein obtaining actual displacement of the elevator in a complete movement status of the elevator further comprises:

obtaining transient acceleration and a total time of the elevator in a complete movement status, obtaining an instantaneous speed of the elevator according to the transient acceleration, and then obtaining the actual displacement of the elevator according to the instantaneous speed and the total time of the elevator.

* * * * *